US009648668B2

(12) United States Patent
Stella et al.

(10) Patent No.: US 9,648,668 B2
(45) Date of Patent: May 9, 2017

(54) INDUCTION HOB

(71) Applicant: Electrolux Professional S.p.A., Pordenone (IT)

(72) Inventors: Gabriele Stella, Udine (IT); Michele Toppano, PoMereto di Tomba (IT); Marco Ulian, Fiumicello (IT)

(73) Assignee: Electrolux Professional S. p. A., Pordenone (IT)

( * ) Notice: Subject to any disclaimer, the term of this patent is extended or adjusted under 35 U.S.C. 154(b) by 696 days.

(21) Appl. No.: 14/025,251

(22) Filed: Sep. 12, 2013

(65) Prior Publication Data

US 2014/0076886 A1 Mar. 20, 2014

(30) Foreign Application Priority Data

Sep. 17, 2012 (EP) ..... 12184693

(51) Int. Cl.
*H05B 6/06* (2006.01)
*H05B 6/12* (2006.01)

(52) U.S. Cl.
CPC ..... *H05B 6/065* (2013.01); *H05B 6/062* (2013.01); *H05B 6/1209* (2013.01); *H05B 2213/03* (2013.01)

(58) Field of Classification Search
CPC ..... H05B 6/062; H05B 6/065; H05B 6/1209; H05B 2213/03
(Continued)

(56) References Cited

U.S. PATENT DOCUMENTS 4,833,288 A * 5/1989 Poumey ..... H05B 6/1245 219/445.1
6,498,325 B1 * 12/2002 Akel ..... H05B 6/065 219/624
2013/0015177 A1 * 1/2013 Clothier ..... A47J 36/027 219/620

FOREIGN PATENT DOCUMENTS

DE 102009020905 12/2010
EP 2268101 12/2010
(Continued)

OTHER PUBLICATIONS

Brandt et al, Cooking hob with a plurality of cooking zones, Dec. 30, 2005, Espacenet,http://translationportal.epo.org/emtp/translate/?ACTION=description-retrieval&COUNTRY.*
(Continued)

*Primary Examiner* — Quang Van
(74) *Attorney, Agent, or Firm* — Pearne & Gordon, LLP

(57) ABSTRACT

An induction hob (100) includes a solid plate (105), and a plurality of electrically activatable coil members (110$_1$-110$_8$) arranged underneath the plate. The define corresponding cooking zones (115$_1$-115$_8$) of the induction hob, and a control unit (135) is configured to select power levels for the cooking zones. Upon selection of first ($P_1$) and second ($P_6$) power levels for non-adjacent first (115$_1$) and second (115$_6$) cooking zones, respectively, the control unit is configured to automatically select for each intermediate cooking zone (115$_2$-115$_5$) between the first and second cooking zones a corresponding power level ($P_2$-$P_5$) obtained by interpolation of the first and second power levels with a predefined interpolating function.

11 Claims, 2 Drawing Sheets

(58) Field of Classification Search
USPC ..... 219/620, 622, 624, 625, 627, 662, 671, 219/672, 675
See application file for complete search history.

(56) References Cited

FOREIGN PATENT DOCUMENTS

| | | |
|---|---|---|
| ES | 2304892 | 10/2008 |
| FR | 2872258 | 12/2005 |
| GB | 2389767 | 12/2003 |
| WO | 2008058614 | 5/2008 |

OTHER PUBLICATIONS

European Search Report for EP12184693.5, dated Jan. 25, 2013, 3 pages.

* cited by examiner

INDUCTION HOB

FIELD OF THE INVENTION

The present invention generally relates to an improved induction hob for food cooking.

BACKGROUND OF THE INVENTION

A conventional induction hob comprises a (e.g., glass-ceramic) solid plate, as well as a number of (e.g., copper) coils placed underneath it and selectively operable for defining one ore more cooking zones.

During operation, after a (e.g., ferromagnetic—such as stainless steel or iron) cooking pan containing food to be cooked is rested on a cooking zone, an alternating electric current is allowed to flow through the respective coil(s), thus generating an oscillating magnetic field. According to well known physical principles, such magnetic field induces an eddy current in the pan, which in turns produces (by Joule effect) resistive heating thereof and hence of the food contained therein.

The induction effect causes heating only of the plate area (of the activated cooking zone) actually covered by the (bottom of the) pan, and only upon contact with it. Therefore, during cooking operations, the induction hob prevents burn injury when touching any plate area free from pans or in close proximity thereto. Moreover, thanks to poor heat-conducting properties of the glass-ceramic material, burn injury is also significantly reduced for those plate areas (of activated cooking zone(s)) which pan has just been removed from.

This allows implementing advanced and safe induction hobs with touch-sensitive control panel directly on the plate.

SUMMARY OF THE INVENTION

The Applicant has found that the known induction hobs are not fully satisfactory in terms of customization.

In fact, the Applicant believes that most of functionalities which all marketed induction hobs are provided with are mainly based on pan detection. Pan detection is used for automatically setting (or changing) cooking zones layout when the user places (or moves) pans on (a top or rest surface of) the plate—typically, a control unit of the induction hob, by cooperation with the coils, is able to detect pan on the plate, combine the coils that are covered at least partly by the detected pan and operate them in a synchronized manner as a single cooking zone.

However, such a totally automatic layout setting could prove to be uncomfortable in many practical cases, especially when the personal cooking approach of the user and/or the particular technique required for cooking a specific dish need customized cooking zones layout.

In this respect, some marketed induction hobs also feature manual layout editing functions, thereby providing the user with a certain customization degree. However, according to the Applicant, such induction hobs are still not compatible with easiness and immediateness needs of the great majority of the users. In fact, before heating of a new pan added on the plate begins, the user has to preliminarily select the cooking zone(s) (among the many cooking zones the induction hobs are typically provided with), and then manually act on the control panel for activation of the selected cooking zone(s) at the desired power level(s).

Thus, the Applicant has understood that users accustomed to easily, quickly and dynamically activating the cooking zones in traditional (e.g., gas or electric) cookers, are not inclined to use induction hobs, neither in domestic nor in professional contexts.

The Applicant has faced the problem of devising a satisfactory solution able to overcome the above-discussed drawbacks.

In particular, one or more aspects of the solution according to specific embodiments of the invention are set out in the independent claims, with advantageous features of the same solution that are indicated in the dependent claims (with any advantageous feature provided with reference to a specific aspect of the solution according to an embodiment of the invention that applies mutatis mutandis to any other aspect thereof).

An aspect of the solution according to one or more embodiments of the present invention relates to an induction hob. The induction hob comprises a solid plate, a plurality of (e.g., eight) electrically activatable coil members arranged underneath the plate (with said coil members that define corresponding cooking zones of the induction hob), and a control unit configured to control the power level of the cooking zones. In the solution according to one or more embodiments of the present invention, upon selection of first and second power levels for non-adjacent first and second cooking zones, respectively, the control unit is configured to automatically select for each intermediate cooking zone between said first and second cooking zones a corresponding power level obtained by interpolation of the first and second power levels with a predefined interpolating function.

According to an embodiment of the present invention, the second power level is higher than the first power level and the predefined interpolating function is a monotonically increasing function, thereby the power level selected for each intermediate cooking zone increases monotonically from the first to the second power levels.

According to another embodiment of the present invention, the first power level is higher than the second power level and the predefined interpolating function is a monotonically decreasing function, thereby the power level selected for each intermediate cooking zone decreases monotonically from the first to the second power levels.

Preferably, although not necessarily, the predefined interpolating function is a linear function.

Advantageously, the selected power levels of adjacent cooking zones may differ from each other by an amount depending on first and second power levels, and number of intermediate cooking zones between the first and second cooking zones.

Preferably, the induction hob further comprises a driving circuit configured to electrically drive the coil members under the control of the control unit.

Without losing of generality, the cooking zones and/or the coil members may have a rectangular or square shape.

According to an embodiment of the present invention, an upper region of a top surface of the plate is formed by a group of adjacent cooking zones, and a lower region of the top surface of the plate comprises at least one cooking zone on each lateral side and a control panel in a central portion thereof, the control panel allowing user selection for operating the induction hob.

Preferably, the solid plate comprises a glass-ceramic material.

Another aspect of the solution according to one or more embodiments of the present invention relates to a method for operating an induction hob. The induction hob comprises a solid plate, a plurality of electrically activatable coil members arranged underneath the plate (with said coil members that define corresponding cooking zones of the induction hob), and a control unit configured to power level of the cooking zones. Upon selection of first and second power levels for non-adjacent first and second cooking zones, respectively, the method comprises interpolating the first and second power levels with a predefined interpolating function, and automatically selecting for each intermediate cooking zone between said first and second cooking zones a corresponding power level based on said interpolation.

The induction hob of the present invention features an operation mode that allows automatic cooking zones selection, without substantially requiring any user intervention during cooking operations, but (initial) operation mode selection. Thanks to the present invention, the induction hob is provided with a (adjustable) number of cooking zones already pre-selected at corresponding power levels, and thus ready to provide induction heating/cooking as soon as cooking pan(s) are placed thereon.

This reminds, and indeed improves, the easy, quick and dynamical cooking zones handling of traditional gas or electric cookers, thus meeting classic cooking needs of many users.

BRIEF DESCRIPTION OF THE DRAWINGS

These and other features and advantages of the solution according to one or more embodiments of the invention will be best understood with reference to the following detailed description, given purely by way of a non-restrictive indication, to be read in conjunction with the accompanying drawings (wherein corresponding elements are denoted with equal or similar references, and their explanation is not repeated for the sake of exposition brevity). In this respect, it is expressly understood that the figures are not necessarily drawn to scale (with some details that may be exaggerated and/or simplified) and that, unless otherwise indicated, they are simply used to conceptually illustrate the described structures and procedures. In particular.

Figure 1:
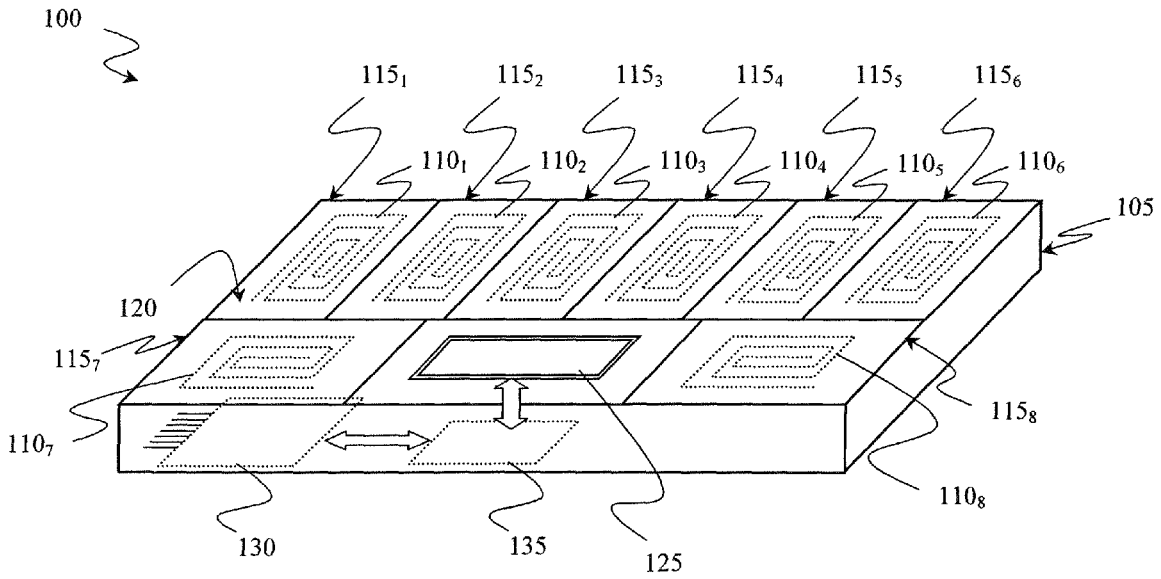
FIG. 1 schematically shows a perspective and partly see-through view of an induction hob according to an embodiment of the present invention, and FIGS. 2A-2C schematically show top views of the induction hob of FIG. 1 at respective phases of an operation mode according to an embodiment of the present invention.

With reference to the drawings, an induction hob 100 according to an embodiment of the present invention is schematically shown in FIG. 1 (wherein, for the sake of illustration ease, components of the induction hob 100 otherwise not visible are represented by dashed lines).

The induction hob 100 comprises a (e.g., glass-ceramic) solid plate 105, and a number N of electrically activatable (e.g., copper) coil members, or coils, $\mathbf{110}_i$ (i=1, 2, . . . , N, with N=8 in the example at issue), for allowing cooking operations by induction. The coils $\mathbf{110}_i$ (e.g., rectangular-shaped) are placed in succession underneath the plate 105 and define corresponding (e.g., rectangular shaped) cooking zones $\mathbf{115}_i$ of the induction hob 100.

Coils arrangement may define the exemplary illustrated cooking zones layout, wherein six of the eight cooking zones (i.e., the cooking zones $\mathbf{115}_1$-$\mathbf{115}_6$, or upper cooking zones) are side by side lengthwise the induction hob 100, up to completely take up an upper region of a top surface 120 thereof. The remaining two cooking zones (i.e., the cooking zones $\mathbf{115}_7$,$\mathbf{115}_8$, or lower cooking zones) are instead arranged at opposite sides of a lower region (below the upper region) of the top surface 120—e.g., turned by 90° with respect to the upper cooking zones $\mathbf{115}_1$-$\mathbf{115}_6$.

Here and in the rest of the description, with "upper" and "lower" cooking zones of the top surface 120 it will be intended the regions that are more distant and closer, respectively, to the user working position.

As visible from the figure, a (e.g., touch sensitive) control panel 125 is provided on the free region of the top surface 120 between the lower cooking zones $\mathbf{115}_7$ and $\mathbf{115}_8$. As usual, the control panel 125 features a user interface allowing to select/enable/operate functionalities, modes, or settings of the induction hob 100.

In order to achieve that, the induction hob 100 further comprises, underneath the plate 105, a driving circuit 130 (e.g., including inverters, rectifiers, filters and/or the like) for electrically activating/driving the coils $\mathbf{110}_i$ (connections not shown), and a control unit 135 (e.g., one or more microcontrollers and/or microprocessors) for properly controlling the driving circuit 130 (as well as other possible electric/electronic components, not shown) according to user selections on the control panel 125.

Considering for example the cooking zone(s) activation, after the user has selected cooking zone(s) by the corresponding command(s) on the control panel 125, and one or more cooking pans (not shown) have been placed on the selected cooking zone(s) $\mathbf{115}_i$, the driving circuit 130, properly controlled by the control unit 135, activates/drives the respective coil(s) $\mathbf{110}_i$ by a driving current (typically, a medium-frequency 20-100 kHz alternating current) allowed to flow therethrough. This creates a magnetic field which passes unobstructed through the plate 105 and penetrates the pans. The magnetic field creates, by induction, a circular current (eddy current) in the electrically conductive (typically, ferromagnetic) base of each pan, which in turns produces (by Joule effect) resistive heating thereof.

Thus, as briefly discussed in the introductory part of the present description, before heating of any new pan added on a new (inactive) cooking zone $\mathbf{115}_i$ takes place, the user has to preliminarily and manually act on the control panel 125 for selecting the cooking zone $\mathbf{115}_i$, and the desired power level, thus making the induction hob 100 not compatible with easiness and immediateness needs of the great majority of the users.

Although the induction hob 100 herein described may be equipped, such as many other known and marketed induction hobs, with totally automatic cooking zones layout setting options (e.g., based on automatic pan detection), this is not enough for providing easy customized use experiences. On the contrary, pan detection further slows down cooking zone activation (e.g., due to intrinsic times required for pan detection itself), and still requires user intervention for power level adjustment of the activated (detected) cooking zone.

According to the present invention, the control unit 135 is configured to implement an operation mode aimed at providing automatically selected cooking zones ready to heat pans at (automatically set/selected) different power levels.

In this respect, hereinafter reference will be made also to FIGS. 2A-2C, the latter schematically showing top views of the induction hob 100 at respective phases of such operation mode according to an embodiment of the invention.

Figure 2A:
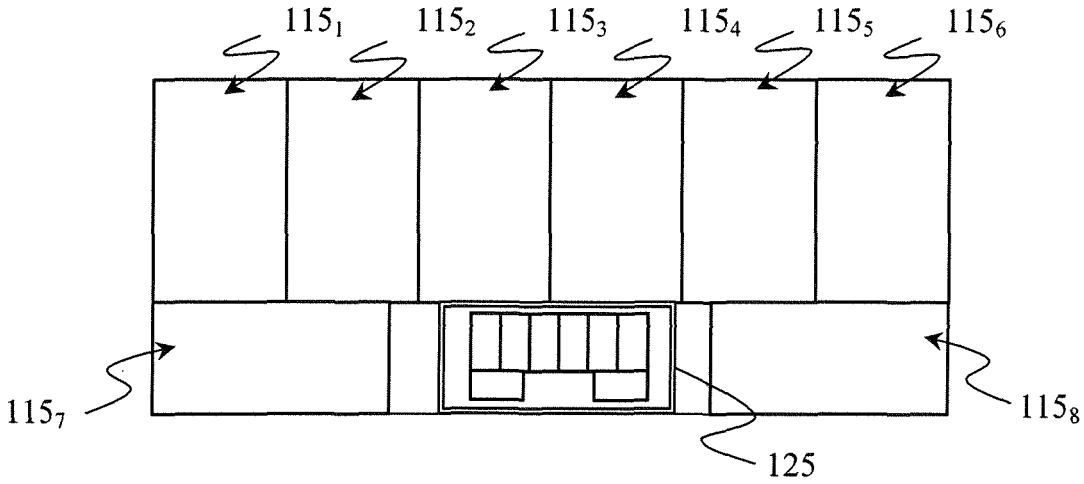

With particular reference to FIG. 2A, after accessing the corresponding menu option of the control panel 125, the user is requested to select two non-adjacent (e.g., upper) cooking zones $\mathbf{115}_i$ from the cooking zones layout map displayed on the control panel 125, and set up them at corresponding desired power levels—meanwhile, the lower cooking zones can instead be operated as usual. As will be shortly understood, the manually selected cooking zones $\mathbf{115}_i$ will be the outer cooking zones of the resulting cooking zones layout.

Figure 2B:
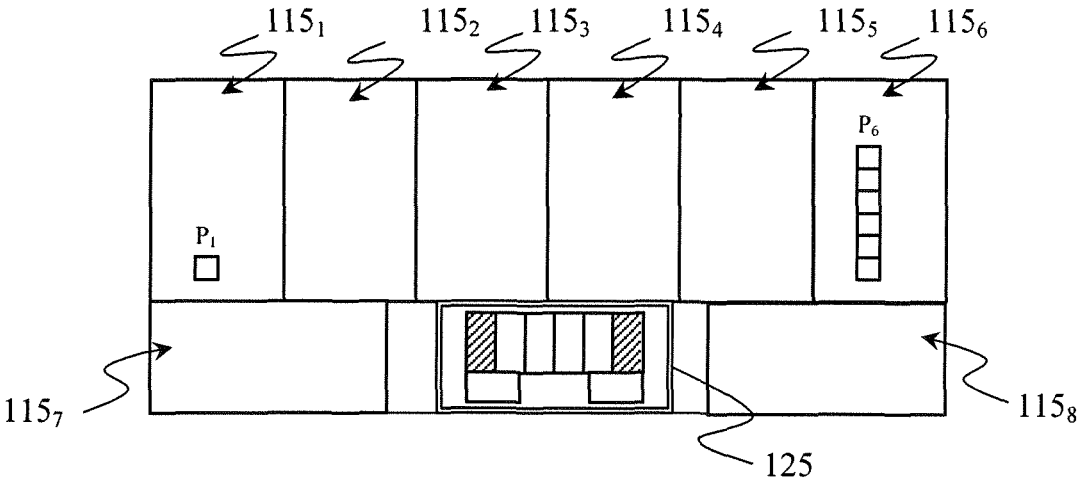
Figure 2C:
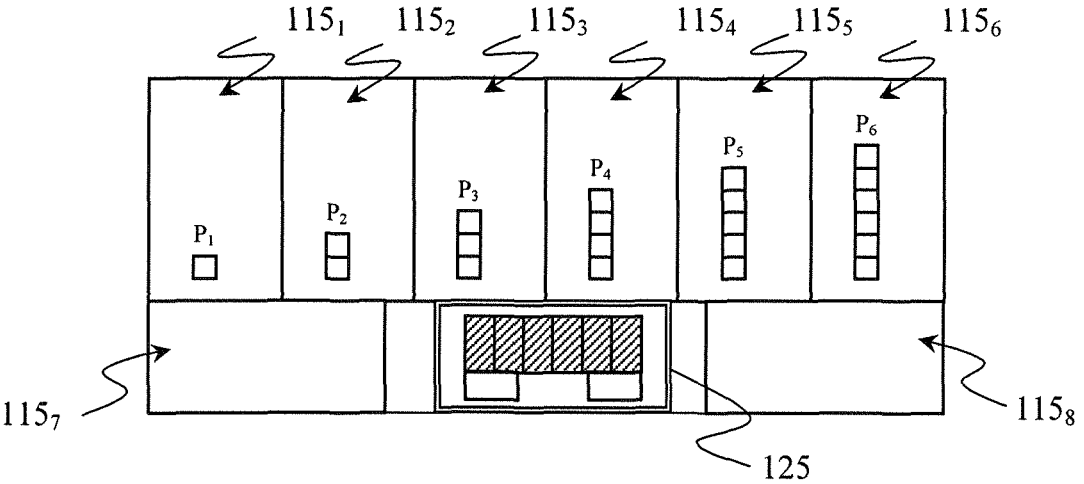

In the exemplary scenario illustrated in FIG. 2B, it has been assumed that the cooking zones $\mathbf{115}_1$ and $\mathbf{115}_6$ have been selected/set up at desired minimum and maximum power levels $P_1$ and $P_6$, respectively (e.g., $P_1$=1 and $P_6$=9, assuming a power levels scale between 0 and 10). This is conceptually illustrated in the figure by power bars within the selected cooking zones (however, as should be readily understood, such power bars, if provided, are more profitably and easily displayed on the control panel 125).

At this point, the control unit 135 automatically selects each intermediate cooking zone $\mathbf{115}_i$ between the manually selected outer cooking zones (i.e., the cooking zones $\mathbf{115}_1$ and $\mathbf{115}_6$), and set it at a corresponding (interpolated) power level obtained by interpolation of the manually pre-set power levels (i.e., the power levels $P_1$ and $P_6$) with a predefined interpolating function.

In this respect, any interpolating functions may be suitable for the purpose—e.g., a monotonically increasing function, a monotonically decreasing function, a polynomial function, or a gaussian function. In the example herein discussed, as shown in FIG. 2C, the predefined interpolating function is a linear function, and the power levels $P_2$-$P_5$ at which the cooking zones $\mathbf{115}_2$-$\mathbf{115}_5$ (and hence the corresponding coils $\mathbf{110}_2$-$\mathbf{110}_5$) are activated are gradually (e.g., uniformly) increasing from left to right. In the disclosed embodiment, each power level $P_1$-$P_6$ differs from the adjacent ones by a constant value (e.g., 1.4, thus, $P_2$=2.4, $P_3$=3.8, $P_4$=5.2, $P_5$=5.6), although any other set of interpolated power levels may be used.

Thus, thanks to the present invention, simple sliding of the pan on the plate 105 allows turning up heating/cooking level.

Advantageously, the control unit 135 allows automatically widening or tightening the cooking zone layout upon cooking zones selection or de-selection, respectively, and/or changing the power levels layout by simply adjusting the power levels of the selected outer cooking zones.

Naturally, in order to satisfy local and specific requirements, a person skilled in the art may apply to the solution described above many logical and/or physical modifications and alterations. More specifically, although the present invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars. Moreover, it is expressly intended that specific elements and/or method steps described in connection with any disclosed embodiment of the invention may be incorporated in any other embodiment as a matter of general design choice.

For example, analogous considerations apply if the induction hob has a different structure or comprises equivalent components, or it has other operating features. In any case, any component thereof may be separated into several elements, or two or more components may be combined into a single element; in addition, each component may be replicated for supporting the execution of the corresponding operations in parallel. It should also be noted that any interaction between different components generally does not need to be continuous (unless otherwise indicated), and it may be both direct and indirect through one or more intermediaries.

For example, without departing from the scope of the invention, the coils (and hence the cooking zones thereby defined) may be in any number and/or shape—e.g., chosen according to specific area occupations issues, or functional or aesthetical requirements. In this respect, the lower cooking zones may also be not provided, or they may have same configuration as, and/or be controlled together with, the upper cooking zones.

Therefore, even though the coils and cooking zones have been described as having a rectangular shape, they may possibly have other shapes, like square or (less preferably) circular or oval.

Moreover, even though the cooking zones are arranged so that each cooking zone of the induction hob is adjacent with at least another one, there can be also cooking zones that are not adjacent to others, provided that there is at least a group of adjacent zones where to apply the principle of the present invention.

The selection of non-adjacent cooking zones may also be not executed at each operation mode access. In fact, although not mentioned before, the induction hob may be provided (e.g., within the control unit) with a data storage support adapted to store selections, settings and options information. Therefore, at each operation mode selection, the power levels of the outer cooking zones selected at a previous operation mode running can be easily retrieved by the data storage support and used as default power levels.

Although in the present description explicit reference has been made to a power level of the (manually selected) first outer cooking zone (first power level) lower than the power level of the (manually selected) second cooking zone (second power level), and to a monotonically increasing (specifically, linear) function as interpolating function, nothing prevents from using other first and second power levels and/or other suitable interpolating functions. For example, in case the first power level is greater than the second power level, a monotonically decreasing (e.g., linear) function may be used, whereas in case the first power level substantially equals the second power level, a Gaussian function as interpolating function may allow implementing a cooking zones layout of the French type—i.e., with power levels being maximum in the middle and decreasing departing therefrom.

The interpolated power levels to be associated with the intermediate cooking zones may be calculated/chosen according to specific selectable criteria. For example, in the number example of above (linear interpolating function), the interpolated power levels differ from each other by an amount depending on the first and second power levels, and number of intermediate cooking zones between the respective (outer) cooking zones. This allows obtaining a cooking zone layout with uniformly increasing power levels. However, non-uniformly increasing power levels could be set—e.g., in the six upper cooking zones example, three pair of cooking zones having minimum, medium and maximum power levels, respectively, may be automatically set by the control unit.

Moreover, the solution according to an embodiment of the invention lends itself to be implemented through an equivalent method (by using similar steps, removing some steps being not essential, or adding further optional steps); moreover, the steps may be performed in different order, concurrently or in an interleaved way (at least partly).

The invention claimed is:

1. Induction hob comprising:

a solid plate, a plurality of electrically activatable coil members arranged underneath the plate, said coil members defining corresponding cooking zones of the induction hob, and a control unit configured to control the power level of the cooking zones, wherein upon selection by a user of non-adjacent first and second cooking zones and first and second power levels for said first and second cooking zones, respectively, the control unit is configured to automatically select for each intermediate cooking zone between said first and second cooking zones a corresponding power level obtained by interpolation of the first and second power levels with a predefined interpolating function.

2. Induction hob according to claim 1, wherein the second power level is higher than the first power level and the predefined interpolating function is a monotonically increasing function, thereby the power level selected for each intermediate cooking zone increases monotonically from the first to the second power levels.

3. Induction hob according to claim 1, wherein the first power level is higher than the second power level and the predefined interpolating function is a monotonically decreasing function, thereby the power level selected for each intermediate cooking zone decreases monotonically from the first to the second power levels.

4. Induction hob according to claim 1, wherein the predefined interpolating function is a linear function.

5. Induction hob according to claim 4, wherein the selected power levels of adjacent cooking zones differ from each other by an amount depending on first and second power levels, and number of intermediate cooking zones between the first and second cooking zones.

6. Induction hob according to claim 1, further comprising a driving circuit configured to electrically drive the coil members under the control of the control unit.

7. Induction hob according to claim 1, wherein the cooking zones have a rectangular or square shape.

8. Induction hob according to claim 1, wherein the coil members have a rectangular or square shape.

9. Induction hob according to claim 1, wherein an upper region of a top surface of the plate is formed by a group of adjacent cooking zones, and a lower region of the top surface of the plate comprises at least one cooking zone on each lateral side thereof and a control panel in a central portion thereof, the control panel allowing user selection for operating the induction hob.

10. Induction hob according to claim 1, wherein the solid plate comprises a glass-ceramic material.

11. Method for operating an induction hob comprising:

a solid plate, a plurality of electrically activatable coil members arranged underneath the plate, said coil members defining corresponding cooking zones of the induction hob, and a control unit configured to control the power level of the cooking zones, wherein upon selection by a user of non-adjacent first and second cooking zones and of first and second power levels for said first and second cooking zones, respectively, the method comprises:

interpolating the first and second power levels with a predefined interpolating function, and automatically selecting for each intermediate cooking zone between said first and second cooking zones a corresponding power level based on said interpolation.

* * * * *